US006246845B1

(12) United States Patent
Hosoya et al.

(10) Patent No.: US 6,246,845 B1
(45) Date of Patent: Jun. 12, 2001

(54) ELECTROPHOTOGRAPHIC MACHINE INCLUDING A BACKUP ROLLER DISPOSED WITHIN AN INTERMEDIATE TRANSFER MEDIUM

(75) Inventors: Masahiro Hosoya, Saitama-ken; Mitsunaga Saito, Chiba-ken; Yasushi Shinjo, Tokyo; Takashi Sasaki; Hirohisa Miyamoto, both of Kanagawa-ken; Koichi Tsunemi, Tokyo, all of (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/398,471

(22) Filed: Sep. 17, 1999

(30) Foreign Application Priority Data

Mar. 30, 1998 (JP) ..... 11-089180
Sep. 17, 1998 (JP) ..... 10-262886

(51) Int. Cl.[7] ..... G03G 15/16; G03G 15/01
(52) U.S. Cl. ..... 399/66; 399/302; 399/308; 399/318

(58) Field of Search ..... 399/66, 121, 297, 399/302, 308, 313, 318; 430/126

(56) References Cited

U.S. PATENT DOCUMENTS 5,264,902 * 11/1993 Suwa et al. ..... 399/318
5,335,054 * 8/1994 Landa et al. ..... 399/318
5,678,150 * 10/1997 Takahashi et al. ..... 399/299

* cited by examiner

*Primary Examiner*—Susan S. Y. Lee
*Assistant Examiner*—Hoang Ngo
(74) *Attorney, Agent, or Firm*—Oblon, Spivak, McClelland, Maier & Neustadt, P.C.

(57) ABSTRACT

An electrophotographic machine including an image forming device configured to form a latent electrostatic image on a latent image carrier, a developing unit configured to develop a visible image from the latent electrostatic image on the latent image carrier with a liquid developer, and a pressure roller configured to apply pressure to an intermediate transfer medium disposed between the latent image carrier and the pressure roller. Further, a contact pressure between the intermediate transfer medium and the pressure roller is larger than a contact pressure between the intermediate transfer medium and the latent image carrier.

41 Claims, 9 Drawing Sheets

ELECTROPHOTOGRAPHIC MACHINE INCLUDING A BACKUP ROLLER DISPOSED WITHIN AN INTERMEDIATE TRANSFER MEDIUM

CROSS-REFERENCE TO RELATED APPLICATIONS

This application claims priority to Japanese Applications No. H10-262886 filed on Sep. 17, 1998 and No. H11-089180 filed on Mar. 30, 1998, both of which are incorporated herein by reference.

BACKGROUND OF THE INVENTION

1. Field of the Invention

The present invention relates to an electrophotographic machine using a liquid developer or a dry developer and a method of printing using the electrophotographic machine.

2. Discussion of the Background

Electrophotographic machines using liquid developers have advantages not realizable by dry electrophotographic machines and so their values have been recognized again in recent years. Wet electrophotography is superior to dry electrophotography for the following reasons: (1) Small toners of submicron size can be used and so high quality can be accomplished; (2) Sufficient image concentration can be obtained with a small amount of toner which is more economical. In addition, good print quality comparable with a printing technology (such as offset printing) can be accomplished; and (3) The toner can be fixed to the paper at a relatively low temperature and so power consumption reduction can be accomplished.

However, wet electrophotography using a background liquid developer has intrinsic problems as described below. Thus, wet electrophotography has permitted dry technology to be in an unchallenged position for a long time. One of the problems with wet electrophotography is associated with the transfer step.

A first problem with the transfer process is a deterioration of the image quality. In particular, in the background technique, developer adhering to a latent image carrier is directly transferred to paper by an electric field in the transfer process. Unevenness of the paper surface varies the electric field, thus producing nonuniform transfer. Furthermore, poor transfer tends to occur due to variations in electrical characteristics of the papers used and their environment-dependence. These problems have considerably deteriorated the quality of the transferred image.

A second problem with the transfer step is an environmental problem caused by adhesion of the solvent to the paper. Where a liquid developer is transferred by an electric field, charged toner particles move through the solvent by electromigration and transfer to the paper. Accordingly, in transfer using an electric field, a given amount of solvent must be interposed between the latent image carrier and the paper. Consequently, a large amount of solvent adheres to the toned paper. This solvent partially evaporates during a fixing process which uses heat and is released out of the machine. This produces odors and adversely affects the human body if the vapor is inhaled. In addition, the paper discharged out of the machine after being fixed still contains a large amount of solvent. If an allergic user touches the paper, skin inflammation such as eczema may be caused.

Some methods for solving these problems have been proposed. These methods include first transferring toner particles containing a given amount of solvent to an intermediate transfer medium and then transferring the particles to the paper. In U.S. Pat. Nos. 5,148,222, 5,166,734, and 5,208,637, there is disclosed a method of transferring toner particles from a latent image carrier to an intermediate transfer medium by an electric field and then to the paper by pressure and heat. In Japanese Patent Publication No. 41679/1971 and Japanese Patent Laid-Open No. 280882/1987, there is disclosed a method of using pressure and/or heat for transfer to an intermediate transfer medium and also for transfer to the paper without using an electric field in the transfer steps.

It is relatively easy to fabricate the intermediate transfer medium from a material that has a smooth surface and electrical resistances that differ less among products or vary less with use. Therefore, image deterioration due to transfer is suppressed to a much greater extent than where direct transfer to the paper is performed using an electric field. Also, where transfer to the intermediate transfer medium is performed using pressure and heat, image quality deterioration is suppressed greatly.

In these proposed methods, transfer to the paper is performed by heat and pressure and so the problems encountered where an electric field transfer is used do not take place.

Furthermore, the solvent adhering to the intermediate transfer medium can be evaporated by heating or can be sucked up (e.g., suction of air) before the transfer to the paper under pressure. Consequently, adhesion of the solvent to the paper can be greatly reduced. Where transfer to the paper is performed by pressure, no solvent is necessary. Hence, such an improvement is possible.

However, these proposed methods pose the following problems in practical applications. First, to transfer toner particles to an intermediate transfer medium using an electric field, it is necessary to fabricate the intermediate transfer medium from a material having both electrical conductivity and resilience. This requirement must also be satisfied in transferring dry developer. If an excessively high pressure is applied to the developer, the adhesive force exerted between the developer and the latent image carrier is increased, making it more difficult to transfer the developer by an electric field.

In the past, therefore, the intermediate transfer medium is made of conductive rubber to achieve both resilience and conductivity. Generally, however, where conductive carbon or the like is added to give conductivity to the rubber, the resilience of the rubber is impaired and it becomes difficult to obtain a soft touch. This urges a use of a relatively hard rubber. Therefore, in order to obtain a soft touch, a latent image carrier and an intermediate transfer medium need to be disposed opposite to each other at a quite high accuracy.

This requirement needs highly accurate components, which in turn results in an increase in the cost and a deterioration in the production yield. Furthermore, the rubber swells due to petroleum-based solvent contained in the liquid developer which varies the thickness. Therefore, the operator must frequently adjust the positional relationship between the intermediate transfer medium and the latent image carrier. Hence, only few choices are available for the conductive rubber material which can minimize such swell, and thus serious difficulties arise.

The aforementioned problems associated with electric field transfer can be circumvented by transferring toner particles to an intermediate transfer medium by pressure. However, the following problems occur. In this case, the toner particles are transferred mainly because of a difference in surface energy or releasability among components. That is, the toner particles are transferred to the intermediate transfer medium only if the surface of the latent image carrier has a releasability higher than that of the intermediate transfer medium.

This releasability relationship is also needed between the intermediate transfer medium and the paper. Accordingly, a clear order of releasability must be established among the latent image carrier, the intermediate transfer body, and the paper. This greatly limits the choices for the materials of these components.

Furthermore, after long term use, the surfaces of the components are contaminated with the developer and so the states of the surface vary. This makes it difficult to maintain the order of releasability as described above. These problems lead to deterioration of the transfer characteristics, which in turn impairs the image quality.

The above-described problems are mainly for the case using liquid developers. However, most of the aforementioned problems also occur in the electrophotographic machines using dry developers. Specifically, when a developer is directly transferred from a latent image carrier to the paper by an electric field, the image quality is deteriorated. In addition, when the paper or the intermediate transfer medium is pressed against the latent image carrier, it is difficult to perform the transfer by an electric field. Where transfer is done by pressure, the order of releasability among the components becomes important, leading to the limitations on selecting materials, and thus the durability is deteriorated. These problems are common to the case where dry developers are employed.

As mentioned above, in the electrophotographic machine using the background liquid development technique, a harmful solvent contained in the solvent tends to adhere to the paper to be discharged from the machine. In transfer using an electric field, unevenness of the surface of the paper and excessively high contact pressure have deteriorated the image quality. In transfer using pressure, problems such as limitations for the choice of the materials for the components and insufficient durability take place. These problems are common to the electrophotographic machines using dry developers.

SUMMARY OF THE INVENTION

Accordingly, it is an object of the present invention to provide an electrophotographic machine which constantly achieves good transfer characteristics and high image quality output, whether the machine is of the wet type or dry type.

To solve the above-noted and other problems, the present invention provides a novel electrophotographic machine in which a gap is formed between an intermediate transfer medium and a backup roller that supports the intermediate transfer medium. In this structure, a latent image carrier and the intermediate transfer medium are in contact with each other under a weak pressure. On the other hand, the paper and the intermediate transfer medium are in contact with each other under a high pressure.

Further, the gap is formed between the backup roller and the intermediate transfer medium on a side of the latent image carrier. On the other hand, on the pressure roller side, the backup roller and the intermediate transfer medium come into contact with each other. At this time, rotation of the backup roller is transmitted to the intermediate transfer medium on the pressure roller side.

The intermediate transfer medium may include a single layer or plural layers, and include a conductive base. A surface release layer may be formed on the conductive base, and the conductive base may be lined with a resilient layer.

It is also possible to form a resilient layer between the intermediate transfer medium and a rigid roller. In this case, the latent image carrier and the intermediate transfer medium lightly contact each other, and the resilient layer may be pressed against the pressure roller to such an extent that the resilient body is compressed.

Further, the intermediate transfer medium may have a belt-like form and be supported by two rollers. The belt-like medium may touch the latent image carrier between the two rollers, and one of the two rollers may touch the pressure roller. In this configuration, the intermediate transfer medium lightly contacts the latent image carrier, and the intermediate transfer medium is pressed against the paper.

In addition, the backup roller supporting the intermediate transfer medium may include a groove. The intermediate transfer medium may be mounted over the groove, and a pressure roller having a width equal to or slightly smaller than the width of the groove may be used. Light contact between the intermediate transfer medium and the latent image carrier is possible because the groove forms a gap between the backup roller and the intermediate transfer medium. Since the pressure roller corresponds to the width of the groove in the backup roller, the pressure roller is fitted in the backup roller, and the intermediate transfer medium and the paper are sandwiched between these two rollers.

The electrophotographic machine constructed as described above can constantly produce a high-quality image output.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
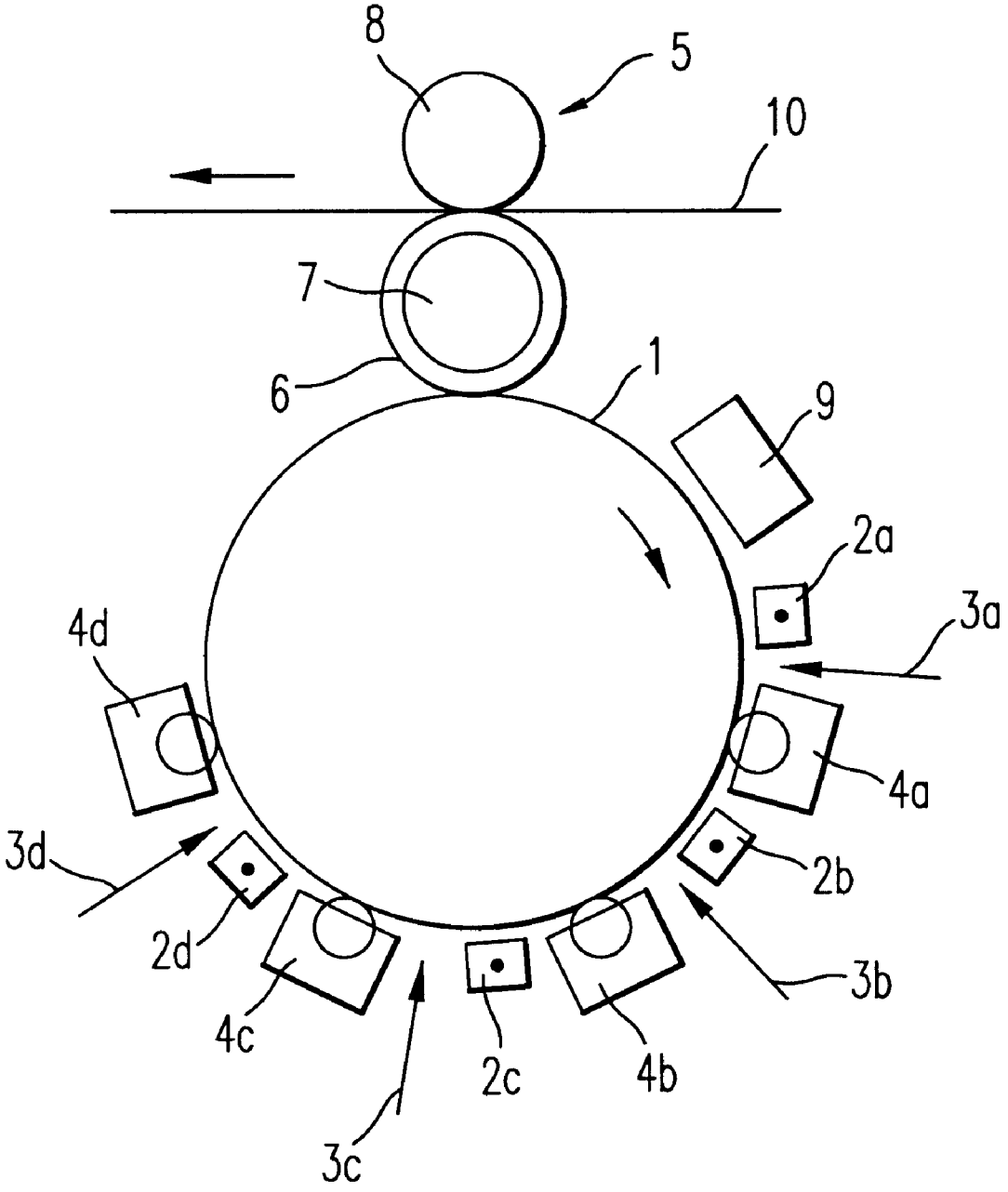
FIG. 1 is a cross-sectional view of an electrophotographic (EP) machine in accordance with an embodiment of the present invention.

Referring now to the drawings, wherein like reference numerals designate identical or corresponding parts throughout the several views, FIG. 1 illustrates an electrophotographic (EP) machine in accordance with an embodiment of the present invention. This machine has a latent image carrier 1 including a photoconductor drum that is a conductive base on which a photoconductive layer of an organic or amorphous silicon-based material is formed. The latent image carrier 1 is uniformly charged by a well-known corona charger or a scorotron charger 2*a*. Then, the carrier is exposed by an image-modulated laser beam (illustrated by the arrow 3*a*), and a latent electrostatic image is formed on the surface of the latent image carrier 1.

Subsequently, the latent electrostatic image is made visible by a developing unit 4*a* containing a liquid developer. Then, a second latent electrostatic image is created by a second charger 2*b* and second laser exposure (illustrated by the arrow 3*b*), and the image is developed by a second developing unit 4*b*. The second developing unit 4*b* includes a second developer having a different color from the color of the liquid developer contained in the first developing unit 4*a*. Therefore, after the second development, a two-color toner image is formed on the latent image carrier 1. Similarly, third and fourth laser exposure processes and developments are performed, to form a full-color toner image on the latent image carrier 1.

The formed toner image is then transferred to the paper by a transfer device 5. At this time, the image may be directly transferred to the paper 10 or via an intermediate transfer portion 6 as shown in FIG. 1. Transfer from the latent image carrier 1 to the intermediate transfer portion 6 and transfer from the intermediate transfer portion 6 to the paper 10 may be performed using an electric field or pressure and heat.

After the first step of laser exposure and development, the liquid developer or toner adhered to the latent electrostatic image may be directly transported to the transfer station and transferred to the paper by the transfer device 5. Where a monochrome image is formed, a single step of exposure, development, and transfer may be performed. Where a full-color image is created, the laser exposure, development, and transfer may be repeated for the number of times equal to the necessary number of colors. Thus, a full-color image may be formed on the paper.

Generally, many liquid developers are fixed to the paper at room temperature. This fixing process may be thermally performed by heating a pressure roller 8 and other components. Examples of this image formation process are described in U.S. Pat. Nos. 5,570,173 and 5,420,675.

Figure 2:
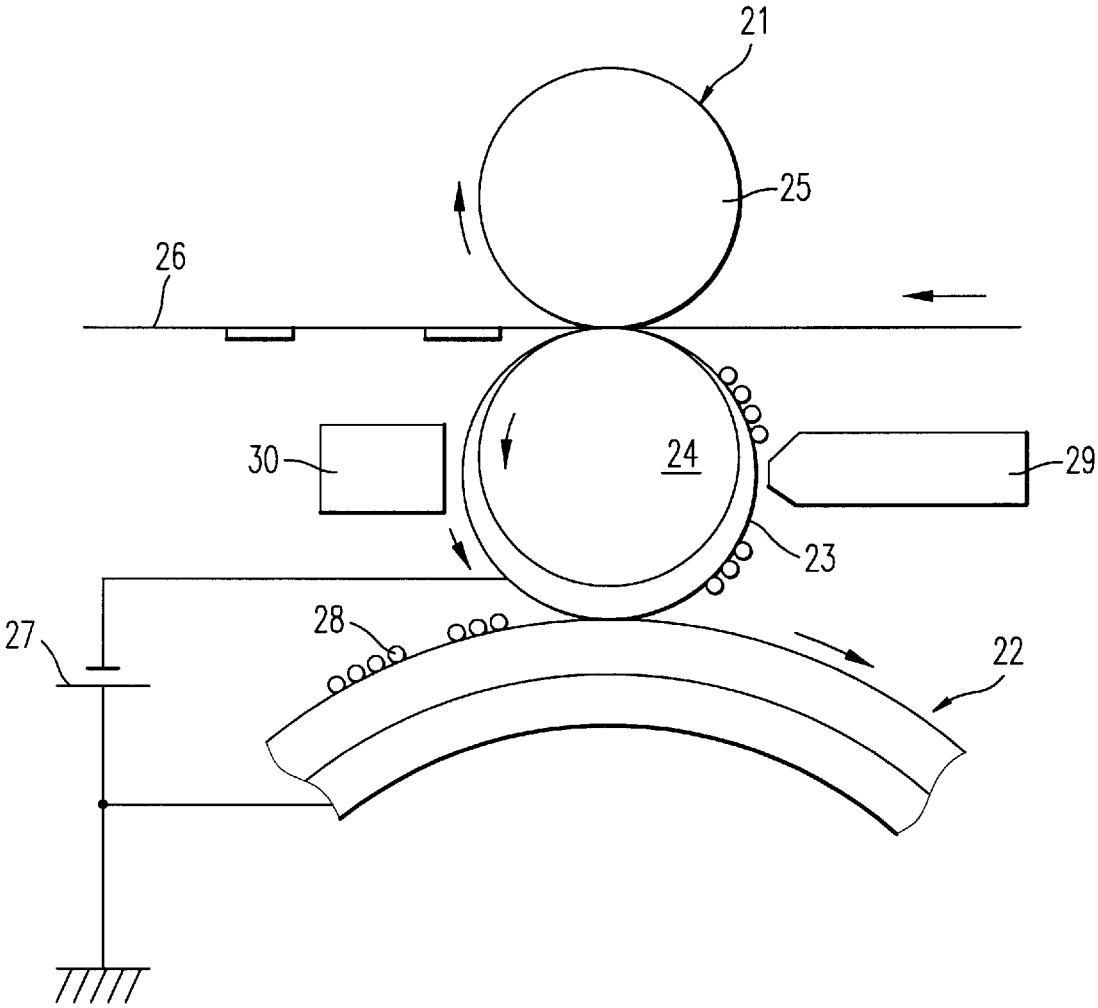
FIG. 2 is a cross-sectional view of the transfer portion of the EP machine in accordance with a first embodiment of the invention.

FIG. 2 is an enlarged view of the transfer device of the EP machine in accordance with the first embodiment of the invention. The transfer device, indicated by numeral 21, includes an intermediate transfer medium 23 including a flexible endless tube, a backup roller 24 having an outside diameter smaller than an inside diameter of the endless tube, and a pressure roller 25. The endless tube is in contact with or close to a latent image carrier 22. Paper 26 is carried between the pressure roller 25 and the intermediate transfer medium 23 by a transport mechanism (not shown) and held between them.

The intermediate transfer medium 23 may be made of an endless tube of a polyimide-based material. The tube may have an inside diameter of about 55 mm, a thickness of about 120 $\mu$m, and a length of about 240 mm, for example. Conductive carbon may be dispersed in the material of the endless tube to give a conductivity of 1 $\Omega$·cm to $10^{14}$ $\Omega$·cm, and more preferably $10^4$ $\Omega$·cm to $10^{10}$ $\Omega$·cm. For example, the conductivity may be about $10^8$ $\Omega$·cm. A transfer voltage of 500 to 2500 V, and more preferably 800 to 1800 V, may be applied to the intermediate transfer medium 23 by a bias voltage source 27. Thus, a transfer electric field may be formed between the intermediate transfer medium 23 and the latent image carrier 22.

The backup roller 24 is rotatably held inside the intermediate transfer medium 23 and has an outside diameter of about 50 mm and has a roller portion about 240 mm in length, for example. The backup roller 24 may be rotated in a counterclockwise direction by a driving mechanism (not shown). In addition, the surface of the backup roller 24 includes a material having a high frictional coefficient such as urethane rubber, silicone rubber, or nitrite butadiene rubber (NBR) which may or may not be foamed, to permit the backup roller 24 to touch the inside of the intermediate transfer medium 23 and to drive it. Further, the rotational speed at a periphery of the backup roller 24 is substantially equal to a rotational speed at a periphery of the latent image carrier 22.

The pressure roller 25 is pressed against the backup roller 24 and the rollers are rotated in a clockwise direction at a speed equal to the rotational speed at the periphery of the backup roller 24. Therefore, the intermediate transfer medium 23 held between them rotates in a counterclockwise direction at a substantially equal speed with the rollers 24, 25.

If the distance between the surface of the backup roller 24 and the latent image carrier 22 is set to a given value (e.g., about 3 mm), the intermediate transfer medium 23 swells toward the latent image carrier 22 because of its resilience. That is, the portion (a lower portion of the backup roller 24 in FIG. 2) on the opposite side of the portion sandwiched between the backup roller 24 and the pressure roller 25 swells toward the latent image carrier 22. Consequently, the intermediate transfer medium 23 lightly contacts the surface of the latent image carrier 22 under a quite small pressure. Owing to this configuration, a light resilient contact necessary in electric field transfer can be easily accomplished.

In FIG. 2, developer 28 on the latent image carrier 22 is transferred to the intermediate transfer medium 23 by an electric field efficiently in the setting described above. An experiment performed by the present inventors has shown that the transfer efficiency constantly exceeded 95% and was normally 100% or close to 100%.

Figure 3:
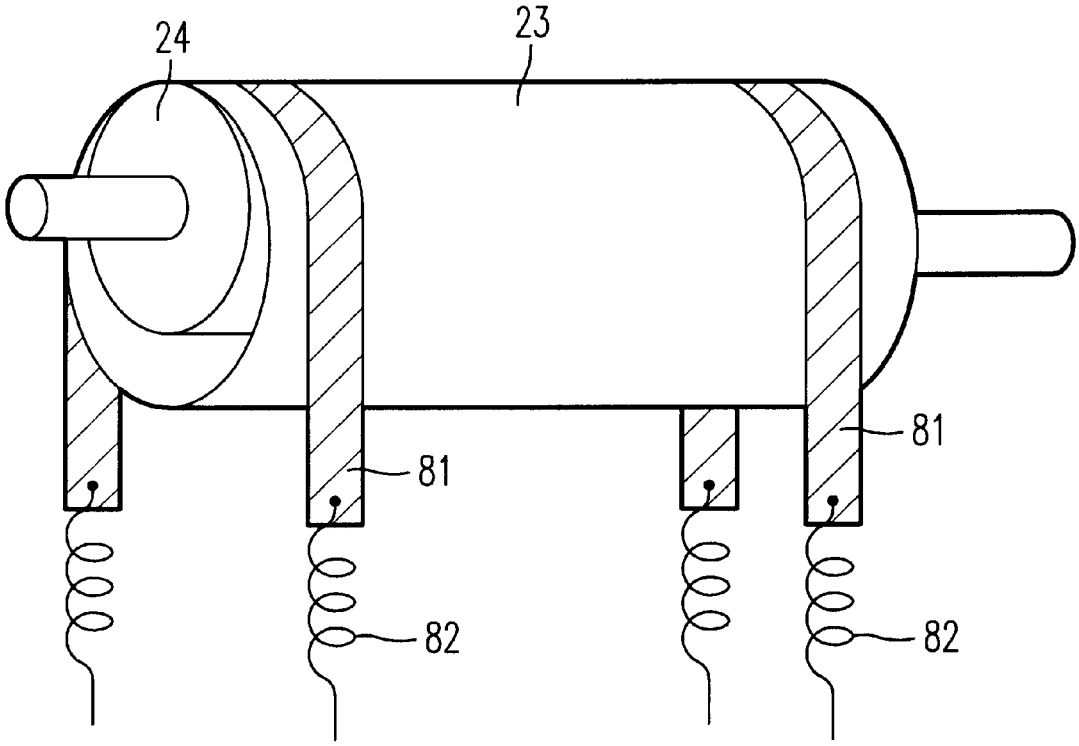
FIG. 3 is a perspective view of a modification of an intermediate transfer medium shown in FIG. 2.

To obtain a more stable contact, tape-like auxiliary members 81 may be stretched on marginal portions of the intermediate transfer medium 23 that are not associated with the image, along an outer surface of the intermediate transfer medium 23 by springs 82, as shown in FIG. 3. This stabilizes the downward swell of the intermediate transfer medium 23.

Examples of the material for the intermediate transfer medium 23 include resins such as polyester, Teflon, and polypropylene, elastomers such as urethane rubber, silicone rubber, NBR, and flexible metal tubes of nickel, stainless steel, and the like in addition to polyimide. Where a resinous material is used, it is desirable to set the thickness to about 50 $\mu$m to 300 $\mu$m, and more preferably about 70 $\mu$m to 180 $\mu$m. If the intermediate transfer medium is too thin, contact with the latent image carrier becomes unstable. If it is too thick, the flexibility deteriorates, and the contact pressure with which the medium is brought into contact with the latent image carrier is increased. This will result in poor transfer. Where a metal tube is used, the thickness is preferably from about 30 $\mu$m to 200 $\mu$m.

Let L1 be the inside diameter of the intermediate transfer medium 23 and L2 be the outside diameter of the backup roller 24. Then, the ratio L1/L2 is preferably about 1.01 to 1.30, and more preferably about 1.03 to 1.1. If this ratio is too small, high machining and assembling accuracy is required. If the ratio is too large, the intermediate transfer medium is driven unstably or brought into contact with the latent image carrier unstably.

In addition, a nip width between the intermediate transfer medium 23 and the latent image carrier 22 is preferably about 0 mm to 20 mm, and more preferably about 2 mm to 10 mm.

Where the contact pressure is quite weak, the intermediate transfer medium 23 may touch the latent image carrier 22 while the liquid developer adhered to the surface of the latent image carrier 22 is raising the intermediate transfer medium 23. Even in this case, electromigration by the transfer electric field assures the transfer. Conversely, if a minute gap exists between the surface of the intermediate transfer medium 23 and the surface of the developer 28, the electric field elongates the developer 28, thus performing the transfer.

Further, transfer to the paper may be accomplished at a high pressure. For instance, a hard rubber having a hardness of about 40 to 100 degrees, and more preferably about 60 to 80 degrees, may be used as the material of the backup roller 24. The rubber hardness is defined by JIS (Japanese Industrial Standards) K6301.

Where a hard roller including a metal roller that may or may not be treated with fluorocarbon is used as the pressure roller 25, a quite high pressure can be applied to the paper 26 and to the developer 28 in contact with the paper.

In pressure transfer, the transfer efficiency increases as the applied pressure becomes higher. Therefore, with this configuration, the efficiency of transfer to the paper can be constantly maintained close to 100%. An experiment performed by the present inventors has revealed that the contact pressure between the pressure roller 25 and the backup roller 24 is preferably about 500 to 10,000 g/cm$^2$, and more preferably about 1500 to 6000 g/cm$^2$.

Figure 4A:
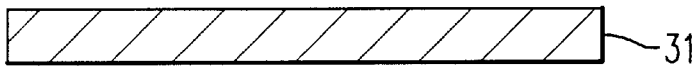
FIGS. 4(*a*)–4(*c*) are cross-sectional views of various examples of the structure of an intermediate transfer medium used in the EP machine in accordance with the first embodiment of the invention.
Figure 4B:
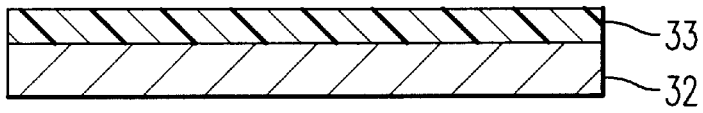
Figure 4C:
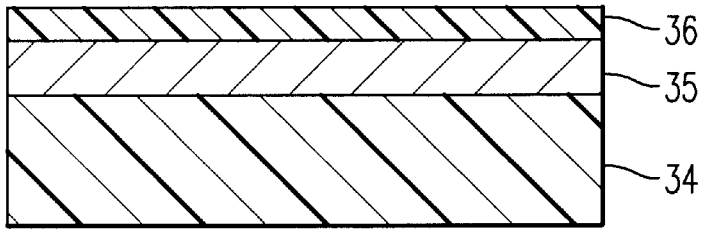

Various examples of layers forming the intermediate transfer medium 23 are shown in FIGS. 4(*a*)–4(*c*). FIG. 4(*a*) shows the simplest example of a layer structure, in which the intermediate transfer medium only includes a conductive base 31. In transferring the developer to the paper, it is desirable that the intermediate transfer medium has a releasability to assure the transfer. Therefore, the conductive base 31 is preferably made of a fluorocarbon resin or a resin that is surface-treated with a fluorocarbon. More preferably, it is made of a silicone resin.

FIG. 4(*b*) shows a layer structure including a conductive base 32 and a surface release layer 33 formed on the surface of the base 32. The release layer 33 is made of a material having a releasability such as fluorocarbons and silicones. This provides a higher releasability than the structure shown in FIG. 4(*a*). If an electrical conductivity is given to the surface release layer 33, a more reliable electric field transfer can be accomplished. If the surface release layer 33 is made of a porous material (more preferably having holes elongated in the direction of the thickness), the diffusion of the liquid developer toward the surface of the intermediate transfer medium can be suppressed after the developer transfers from the latent image carrier; otherwise blurring of the image would be incurred. Hence, a clear image can be maintained.

FIG. 4(*c*) shows a layer structure having a bottom layer made of a resilient layer 34, which provides an appropriate resilience during a pressure transfer. In this case, the drive roller 24 shown in FIG. 2 may be made of a rigid material.

Referring back to FIG. 2, if a solvent removing device 29 is added for removing solvent from the liquid developer transferred from the latent image carrier 22 to the intermediate transfer medium 23, it is assured that adhesion of the solvent to the paper 26 can be reduced. The solvent removing device 29 may be a pneumatic suction device or a device using a porous body such as sponge that absorbs liquid.

Also, a cleaner 30 for removing the developer left on the surface of the intermediate transfer medium 23 after transfer to the paper may be installed. The cleaner 30 may be a well-known blade cleaner, a web cleaner, a sponge cleaner, or a brush cleaner. Of course, if a transfer efficiency of 100% can be maintained, the cleaner 30 is not needed.

Figure 5:
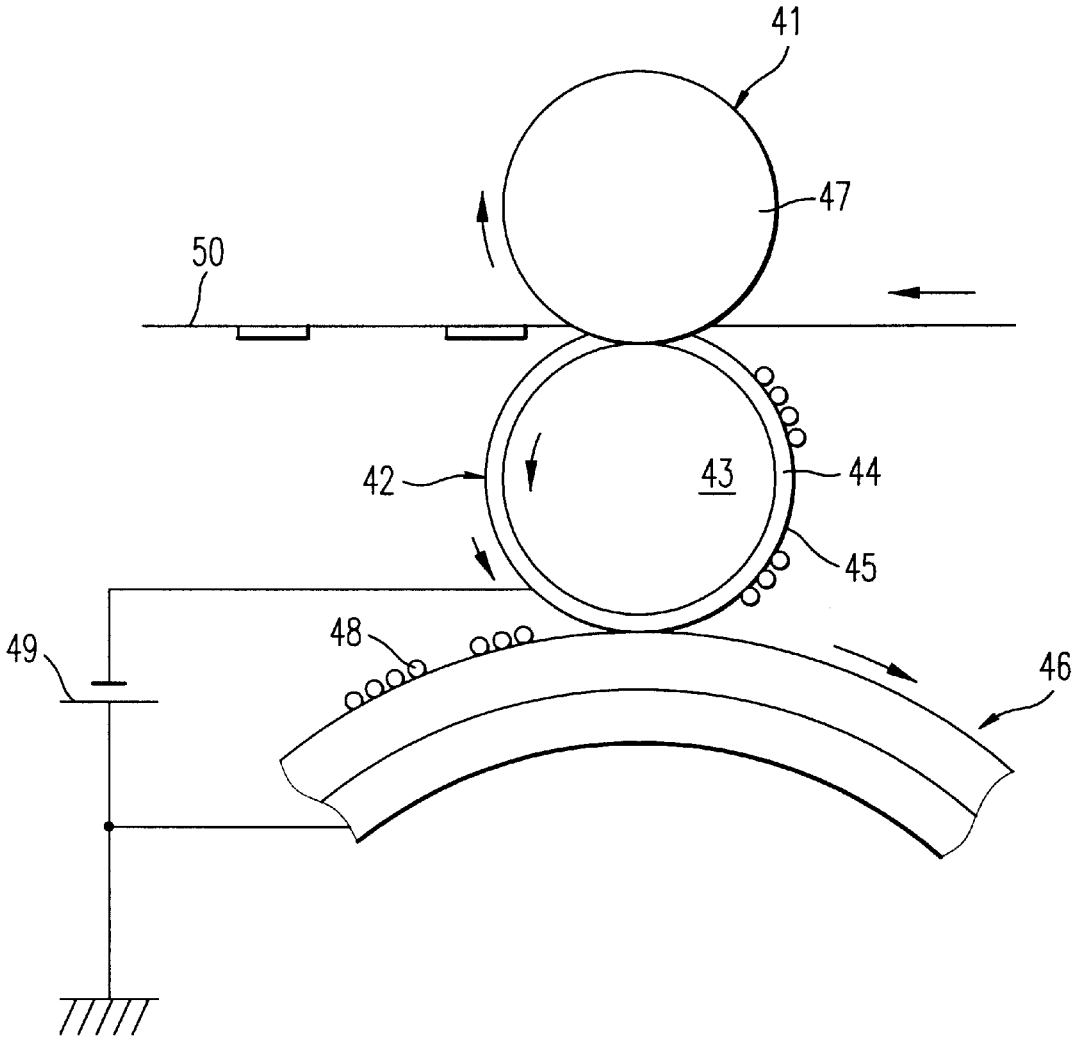
FIG. 5 is a cross-sectional view of the transfer portion of the EP machine in accordance with a second embodiment of the invention.

FIG. 5 is an enlarged view of a transfer device for use in an EP machine in accordance with a second embodiment of the invention. The transfer device, indicated by numeral 41, includes an intermediate transfer roller 42 and a pressure roller 47. The intermediate transfer roller 42 includes a roller base 43, a resilient layer 44 formed on the base, and a conductive layer 45 formed on a periphery of the resilient layer. The conductive layer 45 of the intermediate transfer roller 42 lightly contacts the latent image carrier 46 or is disposed close to it. A transfer voltage may be impressed on the conductive layer 45 by a bias voltage source 49 and a developer 48 may be transferred to the intermediate transfer roller 42 by an electric field.

A soft resilience is given to the intermediate transfer roller 42 by the resilient layer 44 and a surface conductivity is given by the conductive layer 45. In this way, different functions are imparted to different components. Thus, it is not necessary to give a conductivity to the resilient layer 44, and the resilient layer 44 may be made of a quite soft resilient material such as urethane foam. Consequently, a quite light resilient contact with the latent image carrier 46 may be accomplished. Hence, a high transfer efficiency and high image quality may be achieved by an electric field transfer.

The "resilient contact" referred to herein means contact at a pressure at which the elastic limit of the resilient layer is not exceeded. This is described in more detail later with reference to FIG. 5.

The resilient layer 44 may be made of a foam rubber preferably having a hardness of about 2 to 100 kg, and more preferably about 5 to 50 kg, where the measuring method is defined by JIS K6401. Examples of the foam rubber include urethane foam, silicone foam, NBR, urethane rubber, silicone rubber, EPDM, and other foam rubbers. Where solid rubbers are used, a rubber hardnesses of about 5 to 40 degrees, and more preferably about 10 to 30 degrees, measured by a Shore A durometer defined by JIS K6301 should be used. Where liquid developers are employed, it is obvious that materials that are not easily attacked by petroleum-based solvents should be used.

The developer 48 adhered to the surface of the intermediate transfer roller 42 reaches the contact position with the pressure roller 47 by the rotation of the intermediate transfer roller 42 and is transferred to the paper 50. At this time, the pressure roller 47 is pressed against the roller base 43 at a pressure exceeding the elastic limit of the resilient layer 44 of the intermediate transfer roller 42. Accordingly, a quite high pressure can be established, and the developer 48 can be transferred to the paper 50 at a high efficiency. The appropriate range of the pressure is the same as used in the first embodiment described above.

The amount of deformation of the resilient layer 44 under the pressure of the pressure roller 47 affects the image quality, especially where the amount of deformation produced by the pressure is excessively large. That is, the intervening paper 50 and latent image carrier 46 may have a slightly different in rotational speed, thus disturbing the transferred image. The amount of deformation due to the pressure is preferably less than 5 mm, and more preferably between about 0.5 mm and 2.5 mm.

To realize this amount of deformation, it is desirable to set the thickness of the resilient layer 44 to about 0.5 to 8 mm, and more preferably about 1 to 4 mm. Where the thickness is extremely small, a soft contact with the latent image carrier is difficult to maintain. Also in this case, if a surface release layer shown in FIGS. 4(*b*) and 4(*c*) is formed on the surface of the intermediate transfer roller 42. Pressure transfer is achieved with an improved reliability.

Figure 6:
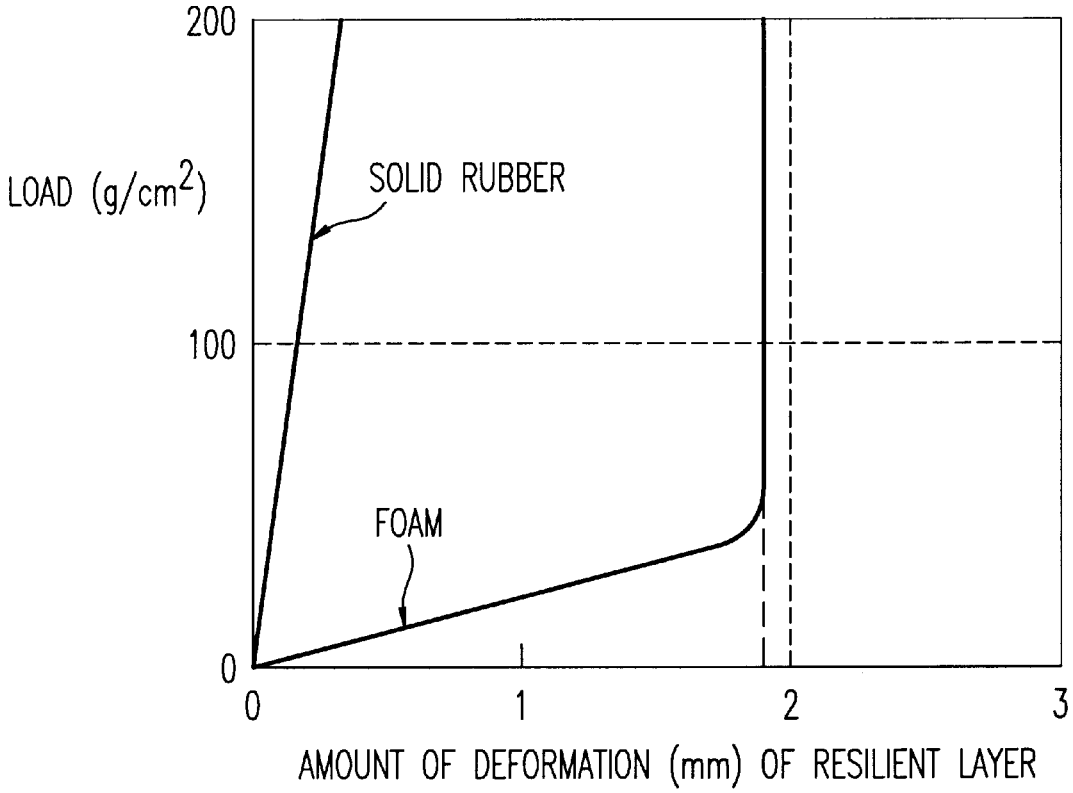
FIG. 6 is a graph showing the characteristics of the resilient layer of the intermediate transfer portion of the EP machine in accordance with the second embodiment of the invention.

To better explain the meaning of "a pressure exceeding the elastic limit," the relationship between the load placed on a resilient body and the amount of deformation is given in FIG. 6. One example shown is a urethane foam having a sponge hardness of 40 kg and a thickness of 2 mm, and another example is a solid rubber including an urethane rubber having a rubber hardness of 60 degrees and a thickness of 2 mm.

If the load applied to the foam is increased to increase the amount of deformation, the load increases rapidly when the amount of deformation reaches about 1.8 mm (a bent point appears on the curve representing the deformation). In this case, therefore, one may judge that 1.8 mm is the elastic limit of this sample. In the case of a solid rubber, the inclination is steep and no bent point appears even when the load reaches 200 g/cm$^2$. In this case, therefore, the elastic limit is not reached. However, a solid rubber having a low hardness exhibits a bent point at a relatively low load and thus may be applied to the present invention.

Figure 7:
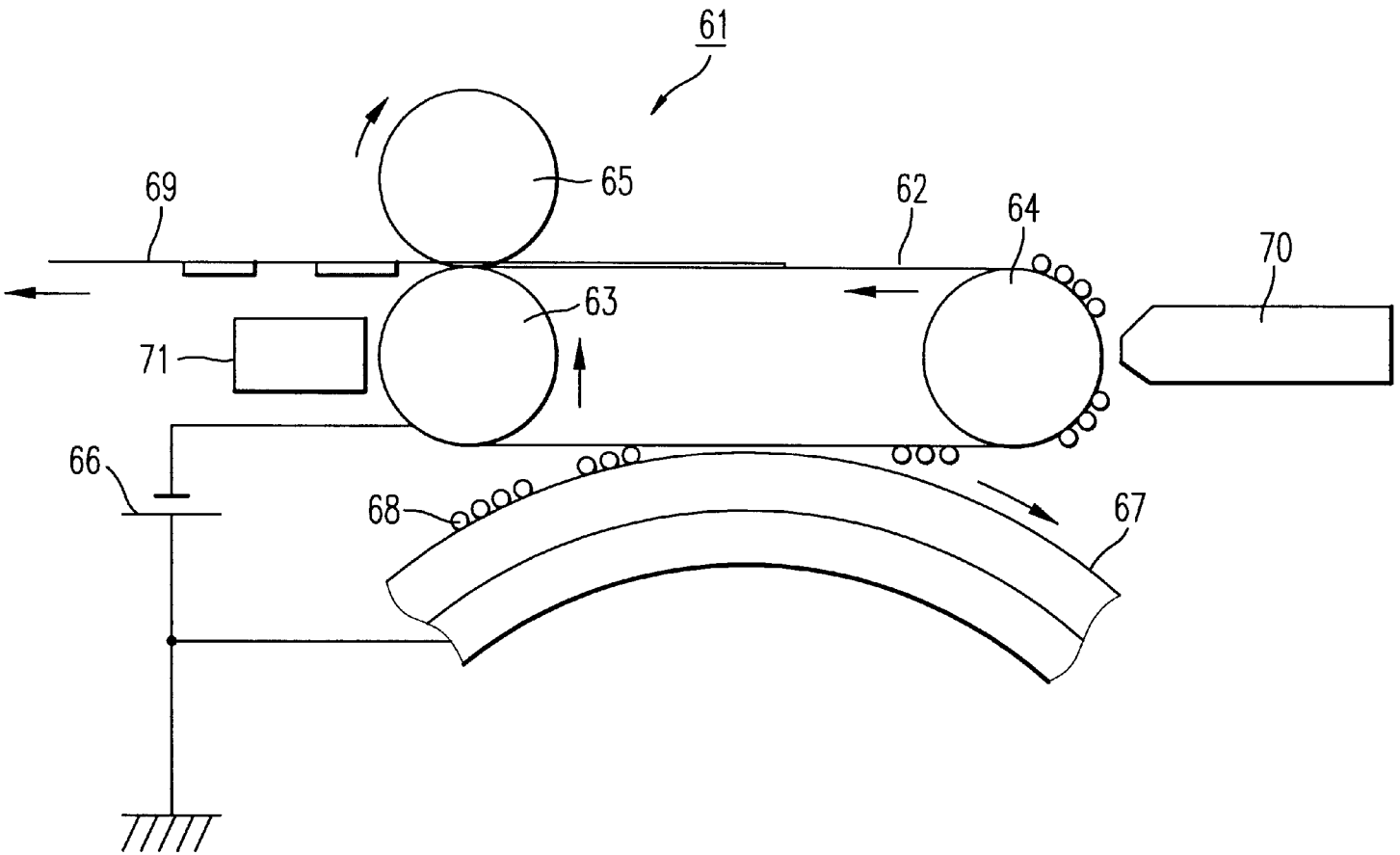
FIG. 7 is a cross-sectional view of a transfer portion of the EP machine in accordance with a third embodiment of the invention.

FIG. 7 shows a transfer device and its periphery according to a third embodiment of the present invention. This transfer device, indicated by numeral 61, includes an intermediate transfer belt 62, a drive roller 63 mounted inside the belt 62, a tension roller 64, and a pressure roller 65. The drive roller 63 drives and provides tension to the belt 62.

The belt 62 has a layer structure identical or similar to any one of the layer structures shown in FIGS. 4(*a*)–4(*c*), and includes a conductive layer to which a transfer voltage is applied from a bias voltage source 66. The belt 62 has a free side that is not in contact with the drive roller 63 or the tension roller 64. This free side is in contact with a latent image carrier 67. Therefore, a quite small contact pressure may be accomplished.

Developer or toner particles 68 transferred to the belt 62 at the position where the belt touches the latent image carrier 67 are carried into the position where they are pressed against the pressure roller 65 by a movement of the belt 62. In this position, the toner particles 68 are transferred to the paper 69 under pressure. The pressure transfer may be performed with an improved reliability by heating any one or all of the belt 62, the drive roller 63, and the pressure roller 65. At the same time, the developer may be fixed to the paper. Of course, a thermal fuser may be mounted after the transfer process.

The pressure roller 65 may be pressed against the drive roller 63 or against the tension roller 64. Therefore, a sufficiently large pressure may be applied to the paper 69 and to the toner particles 68 interposed between the pressure roller 65 and the belt 62. Consequently, a highly efficient transfer may be achieved. In this way, a sufficiently small pressure may be applied in an electric field transfer, and a sufficiently large pressure can be applied in a pressure transfer. As such, a highly efficient transfer and high-quality transfer image can be obtained.

The transfer device of the electrophotographic machine according to the present invention is preferably equipped with a device for removing solvent from the developer on the belt and also with a cleaner for cleaning the surface of the belt after transfer. Since the belt may be placed with a large number of degrees of freedom, the belt is advantageous in placing these components.

As described thus far, the present invention provides an electrophotographic machine which stably achieves a highly efficient transfer and high-quality transfer image, whether the developer is liquid or dry. Where a liquid developer is used, adhesion of the solvent to the paper may be reduced to a minimum, so the solvent can be prevented from discharging from the machine. Hence, a safe and high-performance wet electrophotographic machine for office use can be offered.

In addition, transfer from the latent image carrier to the intermediate transfer medium is performed by an electric field and transfer from the intermediate transfer medium to the paper is performed by pressure. Therefore, a wider choice of materials and an inexpensive electrophotographic machine with a long usage life can be accomplished. Furthermore, in an IOI (image-on-image) process where overlap development is performed and all images are transferred at a time, it is assured that color images registered on the latent image carrier are transferred to the paper and a high-quality color image output can be realized.

A fourth embodiment of the present invention is hereinafter described in detail by referring to FIGS. 8 and 9, which are cross-sectional views of the intermediate transfer portion 6 shown in FIG. 1. The intermediate transfer portion 6 has an intermediate transfer medium 75 mounted over a backup roller 77.

Figure 8:
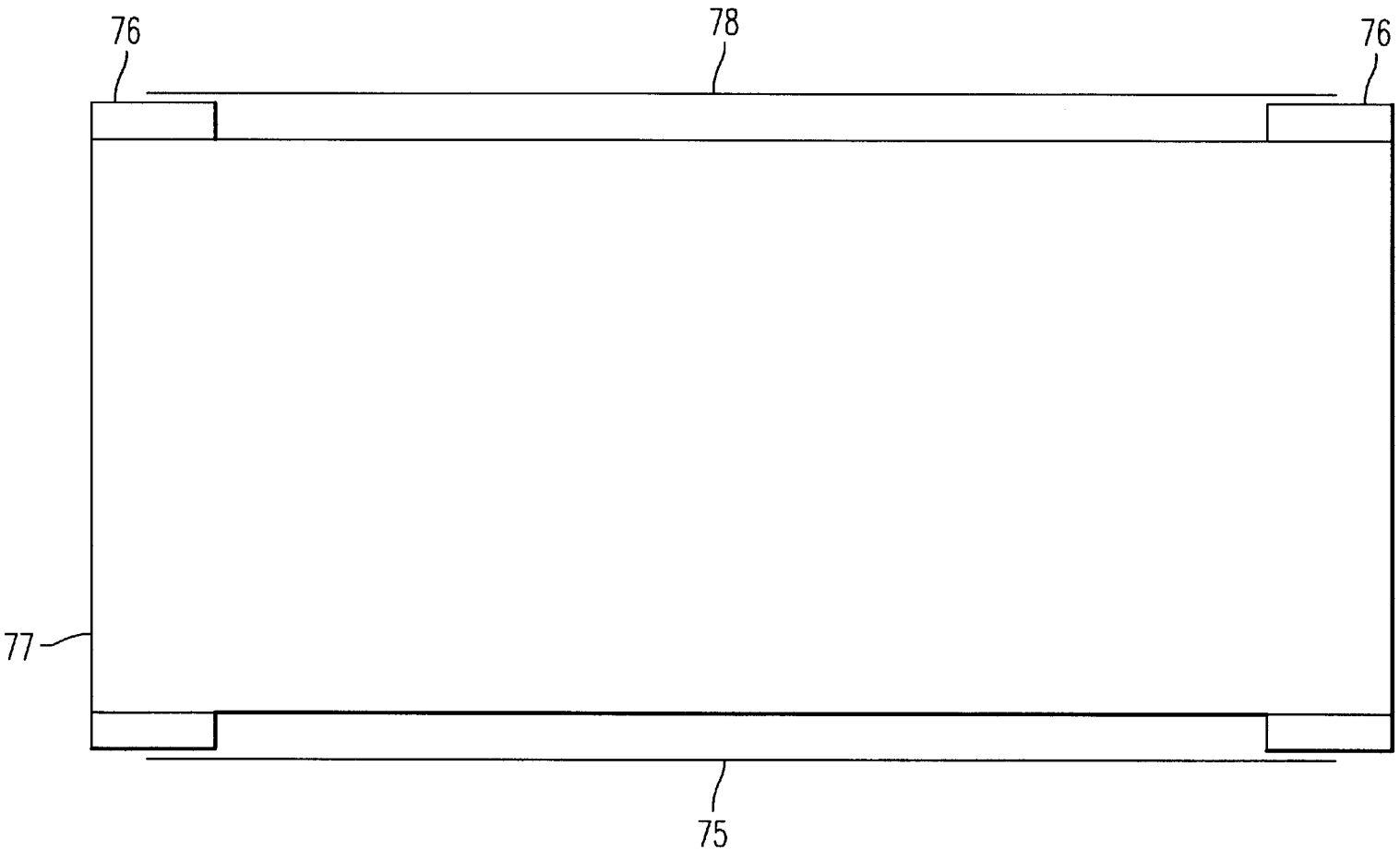
FIG. 8 is a cross-sectional view of an intermediate transfer portion of the EP machine in accordance with a fourth embodiment of the invention.

Referring to FIG. 8, the backup roller 77 is shaped so that the outside diameter of an inner portion is smaller than both end portions 76 and is provided with a groove 78. For example, the outside diameter of both end portions 76 may be about 50 mm, and the groove 78 may have an outside diameter of about 49.5 mm and a length of about 245 mm. The total length of the roller may be about 260 mm, for example. The backup roller 77 may include aluminum, stainless steel, or other metal. Alternatively, the backup roller 77 may include a metal base on which a layer of urethane rubber, silicone rubber, NBR, fluororubber, or the like is formed. The groove 78 in the backup roller 77 preferably has a thickness of about 0.02 to 2 mm, and more preferably about 0.1 to 0.8 mm.

Figure 9:
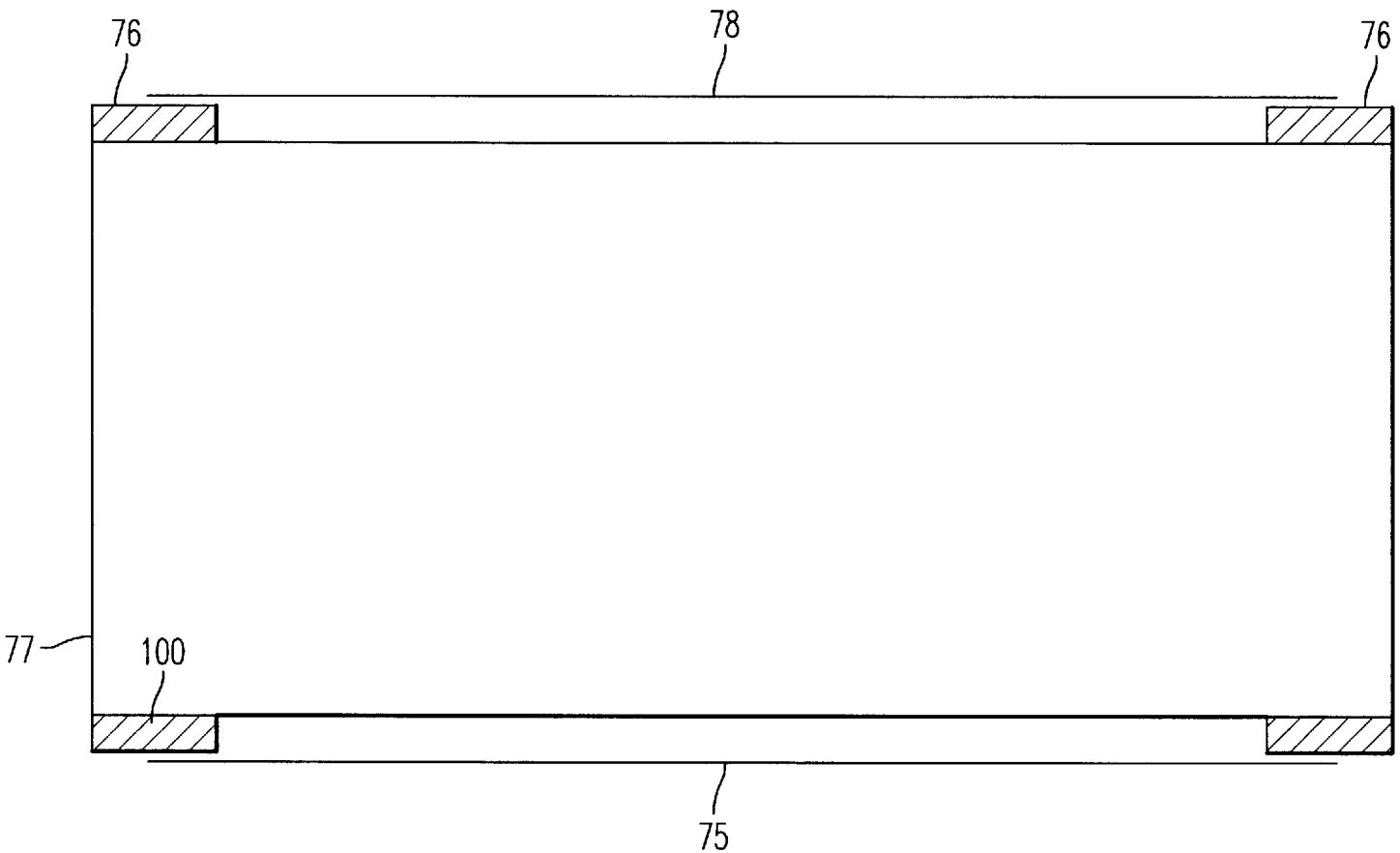
FIG. 9 is a cross-sectional view of another intermediate transfer portion of the EP machine in accordance with the fourth embodiment.

Referring to FIG. 9, the backup roller 77 may include a cylindrical backup roller 77 having both end portions 76 to which resilient supports 100 are attached. In addition, an intermediate transfer medium 75 covers the backup roller 77 and is fixed to both end portions 76 of the backup roller 77. Further, the intermediate transfer medium 75 rotates with the backup roller 77. A small gap is formed between the intermediate transfer medium 75 and the groove 78 in the backup roller 77.

The intermediate transfer medium 75 is an endless tube made of a polyimide-based material and may have an inside diameter of about 50 mm, a thickness of about 100 mm, and a length of about 260 mm, for example. In addition, conductive carbon may be dispersed in the material of the endless tube to achieve a conductivity of 100 Ω·cm to $10^{14}$ Ω·cm, and more preferably $10^4$ Ω·cm to $10^{10}$ Ω·cm. For example, the conductivity may be about $10^8$ Ω·cm. Examples of the material of the intermediate transfer medium 75 include fluororesins such as polyester, polybutadiene, styrelene, acrylics, Teflon, FEP, resins and elastomers such as polypropylene, polyethylene, polyamide, urethane, silicones, NBR, and flexible metal tubes of nickel, stainless steel and the like in addition to polyimide. Where a resinous material is used, it is desirable to set the thickness to about 30 μm to 300 μm, and more preferably about 70 mm to 180 mm. If the intermediate transfer medium is too thin, contact with the latent image carrier becomes unstable. If it is too thick, the flexibility deteriorates, and the contact pressure with which the medium is brought into contact with the latent image carrier is increased, resulting in poor transfer.

In addition, a transfer voltage of about 200 to 2500 V, and more preferably about 400 to 1800 V, may be applied to the intermediate transfer medium 75 by a bias voltage source. Thus, a transfer electric field is formed between the intermediate transfer medium 75 and the latent image carrier 1.

The backup roller 77 is driven by a driving mechanism (not shown) in a direction opposite to the latent image carrier 1 such that the speed of the periphery of the backup roller is substantially equal to the speed of the periphery of the latent image carrier 1. The backup roller 77 includes the groove 78 at a location where the intermediate transfer medium 75 touches the latent image carrier 1. Therefore, the intermediate transfer medium 75 lightly touches the latent image carrier 1 at a quite small pressure. That is, the intermediate transfer medium 75 and the latent image carrier 1 contact each other only by the tension on the intermediate transfer medium 75. With this configuration, a light resilient contact needed in electric field transfer can be readily realized.

However, if the groove 78 in the backup roller 77 is shallower than about 0.02 mm, an appropriate gap cannot be obtained between the backup roller 77 and the intermediate transfer medium 75, thus impairing the flexibility. As a result, an excessive pressure is produced between the backup roller 77 and the latent image carrier 1, which results in a poor transfer. If the groove is deeper than about 2 mm, a pressure from the pressure roller 8 pressed against the intermediate transfer medium 75 excessively deforms the intermediate transfer medium. Consequently, a gap is formed between them, which leads to a poor transfer.

Further, a nip width between the intermediate transfer medium 75 and the latent image carrier 1 is preferably about 0 to 20 mm and more preferably about 2 to 10 mm.

If the contact pressure is quite weak, the liquid developer adhered to the surface of the latent image carrier 1 pushes up the intermediate transfer medium 75. Thus, a film of the liquid developer is interposed between the intermediate transfer medium 75 and the latent image carrier 1. Also in this case, electromigration owing to the transfer electric field assures transfer of the image. Conversely, if a minute gap exists between the intermediate transfer medium 75 and the surface of the layer of the liquid developer, the electric field elongates the developer, thus achieving the transfer.

Further, the paper 10 is transported between the pressure roller 8 and the intermediate transfer portion 6 and passes through them. During this process, the transfer is performed.

The pressure roller 8 may be machined to have a width smaller than the groove 78 in the backup roller 77, and the pressure roller 8 touches the groove 78 via the paper 10 therebetween. In the present embodiment, the pressure roller 8 has an outside diameter of about 30 mm and a total length of about 228 mm, and is made of a metal, hard rubber, or the like.

Accordingly, when an image on the intermediate transfer medium 75 is transferred to the paper 10, the paper 10 and the medium 75 are pressed against each other at a high pressure, producing a good transfer.

If the backup roller 77 is made of a hard rubber having a hardness of about 40 to 100 degrees, preferably about 60 to 80 degrees, or a metal roller, and if the pressure roller 8 is made of a metal roller or a hard roller treated with a fluorocarbon, a quite high pressure can be applied to the paper 10 and to the image in contact with the paper 10. In a pressure transfer, the transfer efficiency increases as the applied pressure becomes higher. With this configuration, the efficiency of transfer to the paper 10 can be constantly maintained close to 100%. An experiment performed by the present inventors has revealed that the contact pressure between the pressure roller 8 and the backup roller 77 is preferably about 500 to 10,000 g/cm$^2$, and more preferably about 1500 to 6000 g/cm$^2$. Owing to the configuration described thus far, the transfer efficiency constantly exceeds 90%. Normally, the efficiency is 100% or close to 100%.

If a solvent removing device 29 is added for removing solvent from the liquid developer transferred from the latent image carrier 1 to the intermediate transfer medium 75 in the same way as in FIG. 2, it is assured that adhesion of the solvent to the paper 10 can be reduced. The solvent removing device 29 may be a pneumatic suction device or a device using a porous body such as sponge that absorbs liquid.

Also, a cleaner 30 for removing the developer left on the surface of the intermediate transfer medium 75 after transfer to the paper may be installed. This cleaner 30 may be a well-known blade cleaner, a web cleaner, a sponge cleaner, a brush cleaner, or the like. Of course, if a transfer efficiency of 100% is maintained, the cleaner 30 is not needed.

In the present embodiment, the intermediate transfer medium 75 may have a layer structure similar to any one of the structures shown in FIGS. 4(*a*)–4(*c*).

As described thus far, the present invention provides an electrophotographic machine which stably achieves a highly efficient transfer and high-quality transfer image, whether the developer is liquid or dry. Where a liquid developer is used, adhesion of the solvent to the paper can be reduced to a minimum and so the solvent can be prevented from discharging from the machine. Hence, a safe and high-performance wet electrophotographic machine used in an office can be offered. Transfer from the latent image carrier to the intermediate transfer medium is performed by an electric field, and transfer from the intermediate transfer medium to the paper is performed by pressure. Therefore, a wider choice of materials and an inexpensive electrophotographic machine with a long usage life can be accomplished.

Furthermore, in an 101 (image-on-image) process where overlap development is performed and all images are transferred at a time, it is assured that color images registered on the latent image carrier are transferred to the paper and a high-quality color image output can be realized. Thus, the invention is quite advantageous in many respects.

Obviously, numerous modifications and variations of the present invention are possible in light of the above teachings. It is therefore to be understood that within the scope of the appended claims, the invention may be practiced otherwise than as specifically described herein.

What is claimed is:

1. An electrophotographic machine comprising:

an image forming device configured to form a latent electrostatic image on a latent image carrier;

a developing unit configured to develop a visible image from said latent electrostatic image on said latent image carrier with a liquid developer;

a backup roller disposed within an intermediate transfer medium and having a circumference smaller than an inner circumference of the intermediate transfer medium;

a pressure roller configured to apply a contact pressure to the intermediate transfer medium wherein said intermediate transfer medium is separated from the backup roller at a position the intermediate transfer medium touches the latent image carrier.

2. The electrophotographic machine according to claim 1, wherein said intermediate transfer medium swells toward the latent image carrier.

3. The electrophotographic machine according to claim 1, further comprising:

auxiliary members slidably contacting both end sides of the intermediate transfer medium and being configured to apply a predetermined pressure to the intermediate transfer medium.

4. The electrophotographic machine according to claim 1, wherein said intermediate transfer medium has a conductivity between about $10^4$ Ω and $10^{10}$ Ω.

5. The electrophotographic machine according to claim 1, wherein said intermediate transfer medium has a thickness between about 70 μm and 180 μm.

6. The electrophotographic machine according to claim 2, wherein a ratio of an inside diameter of said intermediate transfer medium (L1) to a diameter of said backup roller (L2) is:

$$1.0 \leqq L1/L2 \leqq 1.3.$$

7. The electrophotographic machine according to claim 1, wherein a nip width between said intermediate transfer medium and said latent image carrier is larger than 2 mm and smaller than 10 mm.

8. The electrophotographic machine according to claim 1, wherein said intermediate transfer medium has a conductive base covered by a release layer including a porous material.

9. The electrophotographic machine according to claim 8, wherein said release layer has holes elongated in a direction of a thickness of the release layer.

10. The electrophotographic machine according to claim 1, wherein the intermediate transfer medium includes:

a roller base; and a resilient layer formed on the roller base.

11. The electrophotographic machine according to claim 1, further comprising:

a drive roller and a tension roller configured to hold said intermediate transfer medium, wherein said intermediate transfer medium is held between said drive roller and said pressure roller, and said intermediate transfer medium contacts said latent image carrier at a point between said driver roller and said tension roller.

12. The electrophotographic machine according to claim 1, wherein the backup roller has a diameter at a center portion thereof smaller than a diameter at both side portions, and is covered by the intermediate transfer medium.

13. The electrophotographic machine according to claim 12, wherein said visible image is transferred onto said intermediate transfer medium above said center portion of the backup roller.

14. The electrophotographic machine according to claim 1, further comprising:

resilient supports formed on both side portions of said backup roller under said intermediate transfer medium, wherein said backup roller comprises a cylindrical backup roller and is covered by the intermediate transfer medium.

15. An electrophotographic system comprising:

means for forming a latent electrostatic image on a latent image carrier;

means for developing a visible image from said latent electrostatic image on said latent image carrier with a liquid developer;

means for applying a first contact pressure to an intermediate transfer medium disposed between said latent image carrier and said applying means, and including a backup roller disposed within the intermediate transfer medium; and means for swelling said intermediate transfer medium to provide a second contact pressure between said intermediate transfer medium and the latent image carrier, wherein the first contact pressure is larger than the second contact pressure.

16. The system according to claim 15, wherein the intermediate transfer medium is separated from the backup roller at a position the intermediate transfer medium touches the latent image carrier.

17. The system according to claim 15, further comprising:

means for applying a predetermined pressure to both side ends of the intermediate transfer medium so as to press said both side ends against the backup roller.

18. The system according to claim 15, wherein said intermediate transfer medium has a conductivity between about $10^4$ Ω and $10^{10}$ Ω.

19. The system according to claim 15, wherein said intermediate transfer medium has a thickness between about 70 μm and 180 μm.

20. The system according to claim 15, wherein a ratio of an inside diameter of said intermediate transfer medium (L1) to a diameter of said backup roller (L2) is:

$$1.0 \leqq L1/L2 \leqq 1.3.$$

21. The system according to claim 15, wherein a nip width between said intermediate transfer medium and said latent image carrier is larger than 2 mm and smaller than 10 mm.

22. The system according to claim 15, wherein said intermediate transfer medium has a conductive base covered by a release layer including a porous material.

23. The system according to claim 22, wherein said release layer has holes elongated in a direction of a thickness of the release layer.

24. The system according to claim 15, wherein the intermediate transfer medium includes:

a roller base; and a resilient layer formed on the roller base.

25. The system according to claim 15, further comprising:

means for holding the intermediate transfer medium via a drive roller and a tension roller, wherein said intermediate transfer medium is held between said drive roller and said applying means, and said intermediate transfer medium contacts said latent image carrier at a point between said driver roller and said tension roller.

26. The system according to claim 15, wherein the backup roller has a diameter at a center portion thereof smaller than a diameter at both side portions, and is covered by the intermediate transfer medium.

27. The system according to claim 26, further comprising:

means for transferring said visible image onto said intermediate transfer medium above said center portion of the backup roller.

28. The system according to claim 15, further comprising:

resilient supports formed on both side portions of said backup roller under said intermediate transfer medium, wherein the backup roller comprises a cylindrical backup roller and is covered by the intermediate transfer medium.

29. An electrophotographic method comprising:

forming a latent electrostatic image on a latent image carrier;

developing a visible image from said latent electrostatic image on said latent image carrier with a liquid developer;

transferring the visible image on the latent image carrier to an intermediate transfer medium including a backup roller disposed therein with a first pressure; and transferring the visible image on the intermediate transfer medium, which contacts the backup roller, with a second pressure higher than the first pressure, wherein the intermediate transfer medium touches the latent image carrier with a resilience of the intermediate transfer medium.

30. The method according to claim 29, further comprising:

applying a predetermined pressure to both side ends of the intermediate transfer medium so as to press said both side ends against the backup roller.

31. The method according to claim 29, wherein said intermediate transfer medium has a conductivity between about $10^4$ Ω and $10^{10}$ Ω.

32. The method according to claim 29, wherein said intermediate transfer medium has a thickness between about 70 μm and 180 μm.

33. The method according to claim 29, wherein a ratio of said inside diameter of said intermediate transfer medium (L1) to said diameter of said backup roller (L2) is:

$$1.0 \leq L1/L2 < 1.3.$$

34. The method according to claim 29, wherein a nip width between said intermediate transfer medium and said latent image carrier is larger than 2 mm and smaller than 10 mm.

35. The method according to claim 29, wherein said intermediate transfer medium has a conductive base covered by a release layer including a porous material.

36. The method according to claim 35, wherein said release layer has holes elongated in a direction of a thickness of the release layer.

37. The method according to claim 29, wherein the intermediate transfer medium includes:

a roller base; and a resilient layer formed on the roller base.

38. The method according to claim 29, further comprising:

holding the intermediate transfer medium via a drive roller and a tension roller, wherein said intermediate transfer medium is held between said drive roller and said pressure roller, and said intermediate transfer medium contacts said latent image carrier at a point between said driver roller and said tension roller.

39. The method according to claim 29, wherein the backup roller has a diameter at a center portion thereof smaller than a diameter at both side portions and is covered by the intermediate transfer medium.

40. The method according to claim 39, further comprising:

transferring said visible image onto said intermediate transfer medium above said center portion of the backup roller.

41. The method according to claim 29, further comprising:

forming resilient supports on both side portions of said backup roller under said intermediate transfer medium, wherein said backup roller comprises a cylindrical backup roller and is covered by the intermediate transfer medium.

* * * * *

UNITED STATES PATENT AND TRADEMARK OFFICE

CERTIFICATE OF CORRECTION

PATENT NO. : 6,246,845 B1
DATED : June 12, 2001
INVENTOR(S) : Hosoya et al.

It is certified that error appears in the above-identified patent and that said Letters Patent is hereby corrected as shown below:

Title page,
Item [30], the Foreign Application Priority Data should read:
-- [30] Foreign Application Priority Data
Sep. 17, 1998 (JP) ..... 10-262886
Mar. 30, 1999 (JP) ..... 11-089180 --;

Column 1,
First paragraph, the Related Applications information should read:
-- CROSS-REFERENCE TO RELATED APPLICATIONS

This application claims priority to Japanese Applications No. H10-262886 filed on September 17, 1998 and No. H11-089180 filed on March 30, 1999, both of which are incorporated herein by reference. --

Signed and Sealed this

Fifth Day of March, 2002

*Attest:*

*Attesting Officer*

JAMES E. ROGAN
*Director of the United States Patent and Trademark Office*